US005655672A

United States Patent [19]

Stuchlik, III

[11] Patent Number: 5,655,672

[45] Date of Patent: Aug. 12, 1997

[54] SLIDABLE KNIFE HOLDER

[76] Inventor: Charles F. Stuchlik, III, Rte. 1, Box 304-B, Milton, Del. 19968

[21] Appl. No.: 652,332

[22] Filed: May 22, 1996

[51] Int. Cl.[6] ..... A47F 7/00

[52] U.S. Cl. ..... 211/70.7; 211/94.01; 248/37.3; 312/334.23; D7/637

[58] Field of Search ..... 211/70.7, 94, 94.5, 211/162; 248/37.3, 37.6; 312/334.23, 334.24; D7/637, 638

[56] References Cited

U.S. PATENT DOCUMENTS

| | | | |
|---|---|---|---|
| D. 333,238 | 2/1993 | Stead et al. | D7/637 |
| 2,604,997 | 7/1952 | Pearson | 312/334.23 X |
| 2,606,666 | 8/1952 | Gray | 312/334.23 X |
| 2,754,904 | 8/1956 | Hansell et al. | 312/334.24 |
| 2,812,067 | 11/1957 | Gussack | 211/94 X |
| 3,490,601 | 1/1970 | Hain et al. . | |
| 3,846,005 | 11/1974 | Harper et al. . | |
| 4,183,439 | 1/1980 | Bell . | |
| 4,324,377 | 4/1982 | Jones et al. . | |
| 4,537,315 | 8/1985 | Griffin . | |
| 4,854,656 | 8/1989 | O'Keefe | 312/334.23 |
| 5,244,272 | 9/1993 | Thompson . | |
| 5,350,229 | 9/1994 | Smed . | |
| 5,494,176 | 2/1996 | Zallo . | |
| 5,551,580 | 9/1996 | Knutson | 211/94 |

FOREIGN PATENT DOCUMENTS

| | | |
|---|---|---|
| 0 381 815 | 8/1990 | European Pat. Off. . |
| 223453 | 10/1924 | United Kingdom . |

*Primary Examiner*—Robert W. Gibson, Jr.
*Attorney, Agent, or Firm*—Oliff & Berridge

[57] ABSTRACT

A slidable knife holder includes a knife holding block that includes a plurality of slots for holding a plurality of knives and a slidable mount so that the block is slidably mountable to a support structure such as, for example, a cabinet or counter. For example, the block can be slidably mounted under or in cabinets, over sinks, or under counters. According to a preferred embodiment, the knife holder holds the knives in a vertical arrangement (via one or more vertically extending lines of knife holding slots) such that the knife holder has a very small lateral dimension and occupies a very small volume that extends primarily in a vertical direction. The knife holding block slides in a horizontal direction so that the block moves between a retracted position and an extended position.

20 Claims, 8 Drawing Sheets

SLIDABLE KNIFE HOLDER

BACKGROUND OF THE INVENTION

1. Field of the Invention

The invention relates to devices for holding a plurality of knives, and more particularly to devices for holding a plurality of knives in a space saving manner.

2. Description of Related Art

Blocks, typically wooden blocks, that include a plurality of slots to hold a plurality of knives are well known. The most common forms of these knife holding blocks are designed to be simply placed on a countertop so that the knives will be readily accessible. Examples of knife holders that are placed on countertops are shown in U.S. Pat. No. 4,537,315 and in published European Application No. 381,815A1. These devices occupy a certain amount of countertop space, which is rather limited in many homes. This is particularly true for mobile homes and other such recreational vehicles, which typically include very small kitchens and even smaller countertops.

Thus, it is desirable to provide a knife holder that does not occupy any countertop space, yet enables the knives to be readily accessible. Preferably, the knife holder should occupy a minimum amount of space both when it is being used to store knives and when the knives are being accessed from the holder.

U.S. Pat. No. 3,846,005 discloses a knife storage unit that can be mounted to the underside of a cabinet. The knife storage unit includes a hinge so that the storage unit is swingable between a closed position and an open position where the knives can be accessed. While this arrangement does not occupy any countertop space, the swingable nature of the device requires a relatively large volume to allow the unit to swing into the open position.

U.S. Pat. No. 3,490,601 discloses another swingable type knife box that is mounted to a wall. A portion of the box drops downward so that the knives can be accessed. This arrangement also requires a relatively large volume to enable the box to swing into the open position.

U.S. Pat. No. 5,494,176 discloses a child safe cutlery set holder in which a knife holding block is fixedly mounted to the underside of a cabinet. Since the holder is fixedly mounted to the cabinet, the knife handles protrude beyond the front surface of the cabinet and therefore can interfere with movement in that area.

Thus, there is a need for a knife holder that permits the knives to be readily accessible, while occupying a minimum amount of space both when in a knife storage condition and when the knives are being accessed.

SUMMARY OF THE INVENTION

It is an object of embodiments of the invention to provide a knife holder that overcomes the shortcomings in the prior art.

It is another object of embodiments of the invention to provide a knife holder that can be mounted so as not to occupy any countertop space.

In order to achieve the above and other objects, and to overcome the shortcomings in the prior art, knife holders according to embodiments of the invention include a knife holding block that includes a plurality of slots for holding a plurality of knives and a slidable mount so that the block is slidably mountable to a support structure such as, for example, a cabinet or counter. For example, the block can be slidably mounted under or in cabinets, over sinks, or under counters.

According to a preferred embodiment of the invention, the knife holder holds the knives in a vertical arrangement such that the knife holder has a very small horizontal (lateral) dimension and occupies a very small volume that extends primarily in a vertical direction. The slidable knife holder of this preferred embodiment includes a knife holding block having first and second vertical side walls that extend in parallel vertical planes. A plurality of spacer elements attach the first vertical side wall to the second vertical side wall. The plurality of spacer elements are spaced from each other to define a plurality of knife holding slots that extend in at least one vertical line located between the first and second vertical side walls. A first part of a slidable mount is provided on the top of the knife holding block and is slidably engagable with a second part of the slidable mount. The second part of the slidable mount includes an attachment element such as, for example, glue or screws, that enables the second part to be mounted to a support such as, for example, a cabinet or counter. The second part of the slidable mount is engaged with the first part so that the first and second parts are slidable relative to each other in a horizontal direction. The knife holding block moves with the first part in the horizontal direction so that the block slides between a retracted position and an extended position.

Preferably, when in the retracted position, the handles of the knives in the block are located (i.e., hidden) below the cabinet or counter and thus do not interfere with movement in front of the cabinet or counter. When the block is moved into the extended position, the knife handles are exposed and readily accessible.

A variety of different slidable mount structures can be used.

The slots preferably extend at an angle so that the handles of knives inserted into the slots extend upwardly at an angle, as is commonly done to prevent the knives from falling out of the block.

One or more vertically extending lines of slots can be provided in the knife holding block. For example, a divider member can be provided between the first and second side walls with spacer elements attaching the first and second side walls to opposite sides of the divider member so as to provide two adjacent vertically extending lines of slots. Such an arrangement would double the knife holding capacity of the knife holder, while still occupying a very small space.

In an alternative embodiment, the line of slots can extend in a horizontal direction.

The knife holder can be made from a variety of materials such as, for example, plastic or wood. The block and knife handles can be provided in a variety of colors or color combinations so as to have a pleasing appearance. For example, when made from plastic, the block can be white while the knife handles are black. The block and knife handles also can be made from wood and provided in a variety of finishes to match the finish of typical kitchen cabinets such as, for example, light oak, bleached oak, honey oak, walnut, cherry, maple, mahogany, etc.

The spacer elements can be separate pieces from the walls of the knife holding block or can be one-piece therewith. For example, in the vertical arrangement, the spacer elements could be separate pieces of plastic that are glued between plastic side walls. Alternatively, the spacer elements could be molded into one or both of the side walls. When the knife holding block is made from wood, a router could be used to form the slots in one or both of the side walls, in which case the spacer elements would be one-piece with one or both of the side walls.

The spacer elements and walls could be glued together, attached by other forms of non-detachable fixing elements (such as rivets) or attached with detachable fasteners such as, for example, pins or screws. The knife holding block preferably includes a handle or other type of grasping member so that the knife holding block can be easily grasped and pulled from the retracted position to the extended position.

Labels can be placed adjacent to each slot to identify the type of knife to be located therein.

BRIEF DESCRIPTION OF THE DRAWINGS

The invention will described in conjunction with the following drawings in which like reference numerals designate like elements and wherein.

DETAILED DESCRIPTION OF PREFERRED EMBODIMENTS

A preferred embodiment of the invention is illustrated in FIGS. 1–5. The preferred embodiment is a slidable knife holder that extends primarily in a vertical direction (as compared to a horizontal direction) when viewed from the front. This arrangement is preferable because it occupies only a small amount of space in the horizontal (lateral) direction. This enables the knife holder to be readily mounted under counters or cabinets or to the side of surfaces such as a cabinet side wall or a vertically extending wall. The alternative embodiment, in which the line of knife holding slots extends horizontally, requires a substantial amount of horizontal space, which may not be available in recreational vehicles, for example.

Figure 1:
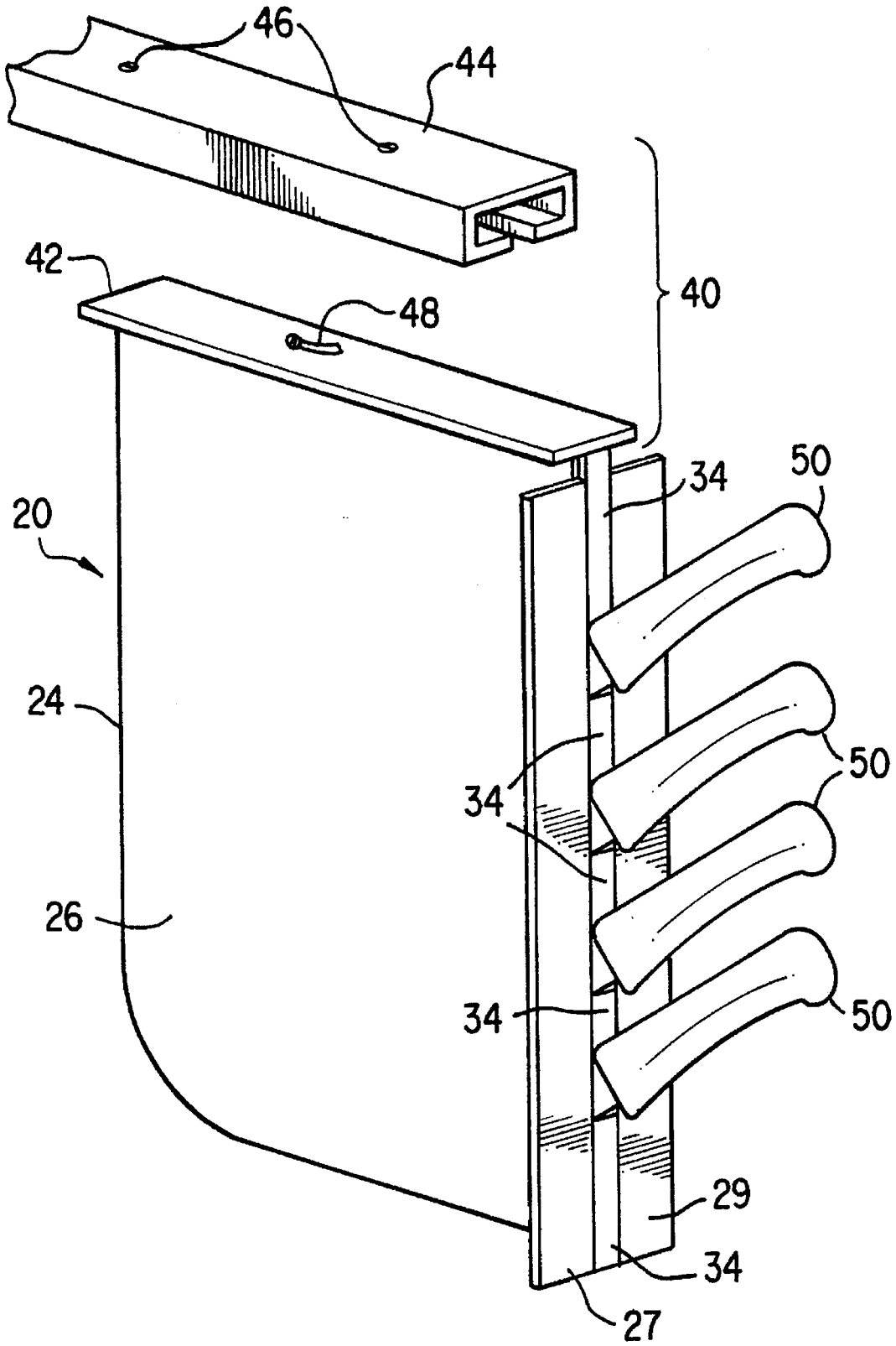
FIG. 1 is a perspective view of a first embodiment of the invention in which the knife holder extends predominantly in a vertical direction.

Referring to FIG. 1, a vertically extending slidable knife holder 20 includes a knife holding block 24 that is comprised of a first (left in the drawing) vertically extending side wall 26 and a second (right in FIG. 2) vertically extending side wall 28. A plurality of spacer elements 34 attach vertical side wall 26 to vertical side wall 28. The plurality of spacer elements 34 are spaced from each other to define a plurality of knife holding slots 35 (see FIG. 2). As is evident from FIG. 1, the inlet openings for the plurality of slots 35 extend in a vertical line between the vertical side wall 26 and the vertical side wall 28.

Figure 3:
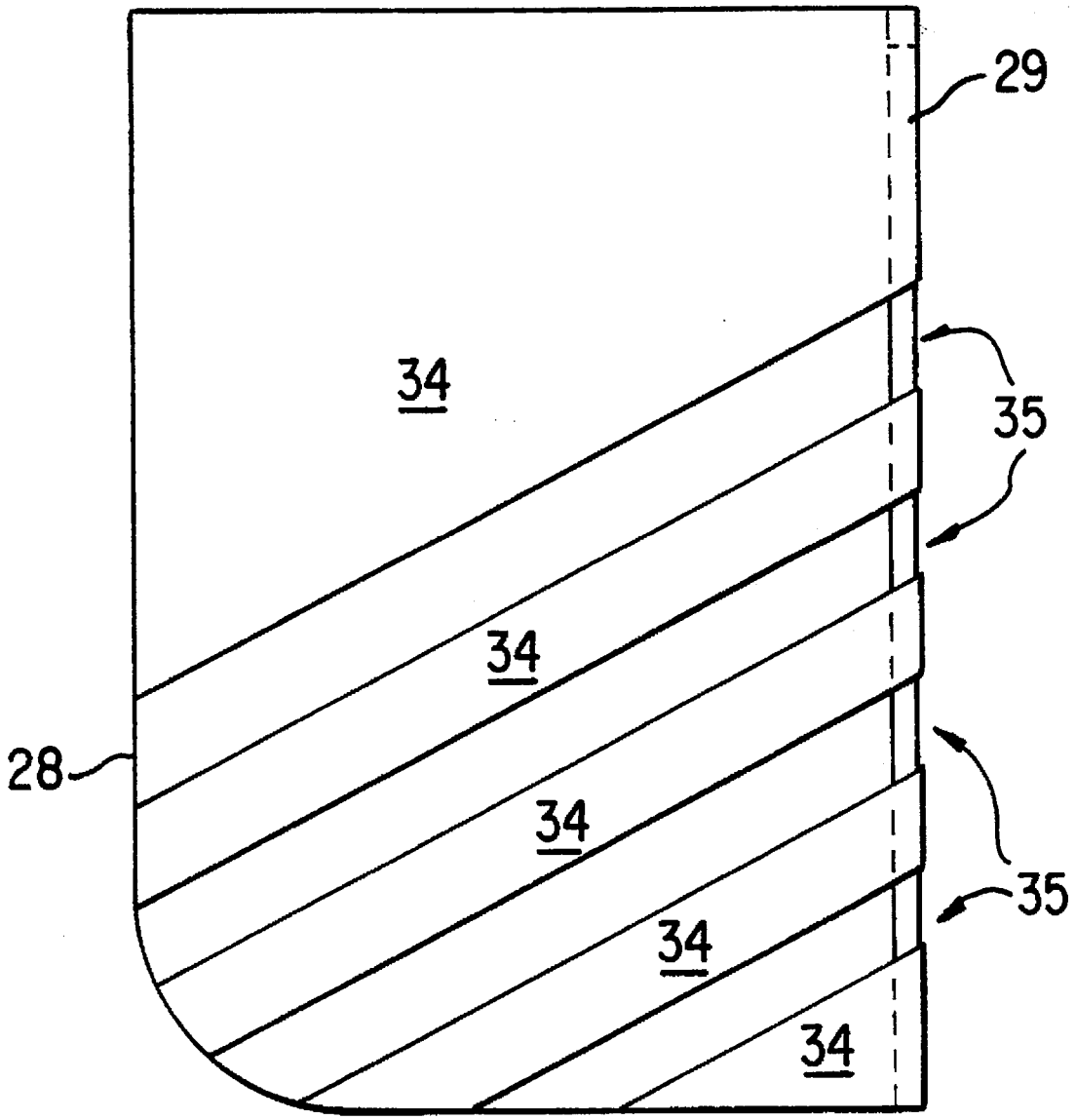
FIG. 3 is a side view of one of the side walls from the FIG. 1 embodiment, and illustrates the spacer elements attached to that side wall.

FIG. 3 illustrates one very simple manner in which the slots can be formed between the vertical side walls. FIG. 3 is a side view of the right vertical side wall 28 as viewed from the left side in FIG. 1 (i.e., prior to attachment to the left vertical side wall 26). In this example, the plurality of spacer elements 34 are glued to right vertical side wall 28 so as to form four slots 35 therein. The slots 35 preferably extend diagonally so that the knives 50 will not fall out of the knife holder 20 when mounted. The left side wall 26 then would be glued, or otherwise attached, to the right side wall 28 via the spacer elements 34.

It is very convenient to make the knife holding block 24 from plastic because plastic spacer elements 34 simply can be glued between plastic side walls 26 and 28. As an alternative, it is possible to glue spacer elements 34 to one of the side walls, for example side wall 28, and then attach the other side wall 26 using detachable fasteners such as screws or clips, for example. Nondetachable fasteners such as rivets, for example, also can be used.

As another alternative, the spacer elements can be one-piece with one of the side walls (or some of the spacer elements can be one-piece with one side wall, and other spacer elements one-piece with the other side wall). For example, when using plastic, the spacer elements can be molded into one or both of the side walls. The side walls can then be attached to each other either detachably (e.g., with screws or clips) or non-detachably (e.g., with glue).

When constructing with wood, separate wood spacer elements can be used or the spacer elements can be formed into one or both of the side walls by using a router. As with the plastic version, the side walls and/or spacer elements can be inter-connected using glue, rivets, screws, etc.

Although five spacer elements 34 are shown that provide four slots, more or less spacer elements and slots can be provided. Additionally, the spacer elements could be made wider (laterally) and spaced closer together (vertically) so that each slot would extend left-to-right instead of straight up-and-down as in FIG. 1. While such an arrangement would have a greater lateral dimension, it would have a much smaller vertical dimension and therefore would provide a very compact knife holder. As another alternative, the spacer elements can be shaped so that each slot extends diagonally.

In order to provide for the slidable mounting of the knife holder, a first part 42 of a slidable mount 40 is provided on the top of the knife holding block 24. In the FIG. 1 embodiment, a rectangular piece of plastic 42 is glued to the top of the top spacer element 34 and to the tops of the side walls 26 and 28. As can be seen from FIG. 2, when viewed from the front, this results in a T-shaped structure that includes left lateral wing **42*a* and right lateral wing 42*b***.

A second part of the slidable mount 40 is defined by a bracket 44. Bracket 44 includes attachment elements such as, for example, screws 46 that enable the bracket 44 to be fixedly mounted to a support such as, for example, the underside of a counter or cabinet. The lateral wings **42*a* and 42*b* are received in slots 44*a* and 44*b* of the bracket 44 so that the plastic piece 42 and bracket 44** are slidable relative to each other in a horizontal direction (when mounted).

Figure 4:
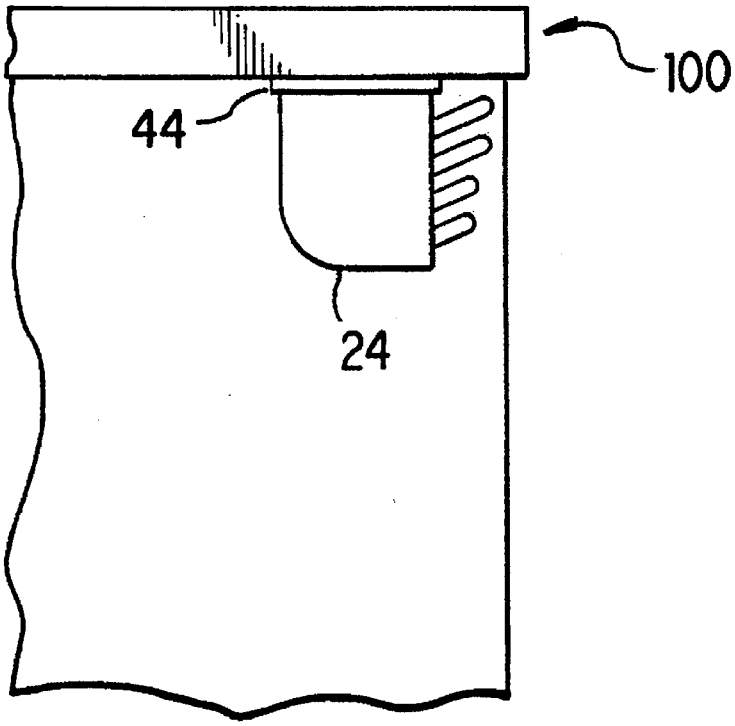
FIG. 4 is a side view of the FIG. 1 knife holder mounted to a cabinet and located in the retracted position.
Figure 5:
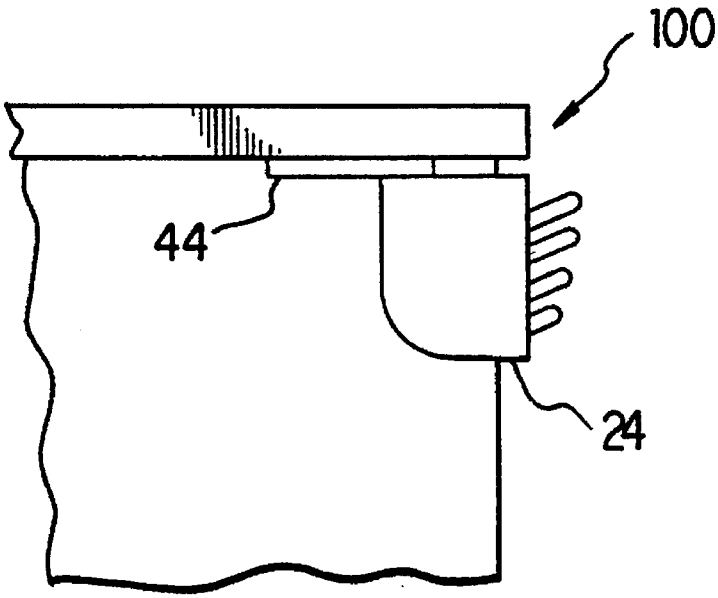
FIG. 5 is a view similar to FIG. 4, but shows the knife holder in the extended position.

The knife holding block 24 moves along with plastic piece 42 in the horizontal direction so that the block 24 moves from a retracted position to an extended position. A stop element such as, for example, a resilient spring-like metal member 48 can be provided on the plastic piece 42 to limit the outward movement of the block 24. The stop element 48 would engage a stop member (not shown) located on the underside of bracket As illustrated in FIGS. 4 and 5, the knife holder can be mounted to the underside of a counter 100, for example when in the fully retracted position, the handles of knives 50 are entirely beneath the counter 100. Accordingly, the knife handles are hidden and do not obstruct movement in front of the counter 100. When the knife holding block 24 is moved (by sliding) to the extended position, as shown in FIG. 5, the knife handles are exposed and readily accessible. As an alternative to placing the slidable mount 40 on top of the vertically extending block 24, the slidable mount can be placed on other portions of the block 24. For example, the slidable mount can be located on the side of the knife holding block 24 so that the knife holder 20 can be mounted to a vertically extending surface such as a wall or a side wall of a cabinet.

A variety of slidable mount structures can be used. Preferably, the mount provides some minimal friction resist so that the knife holding block stays in the retracted position when not being used. This also makes it less likely that a user will pull the knife holding block from the retracted position to the extended position too suddenly, which might cause one or more of the knives to fall out of the knife holder. Thus, it is not necessary, or even very desirable, to include rollers in the slidable mount.

Figure 2:
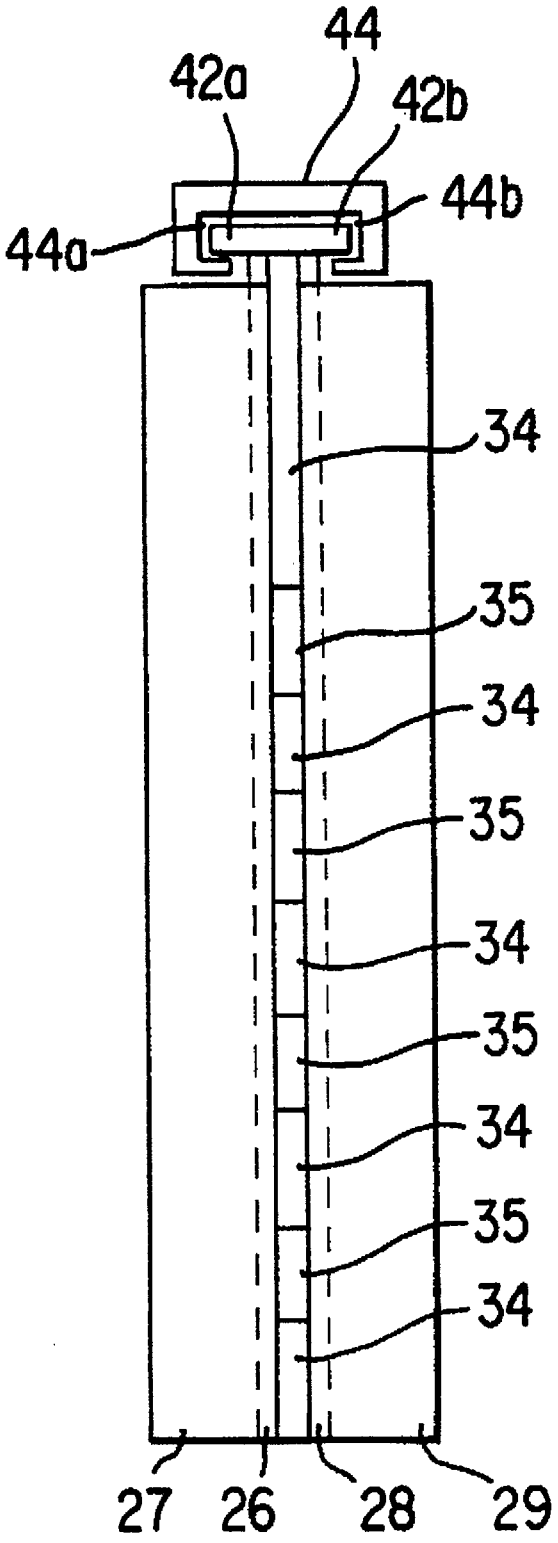
FIG. 2 is a front view of the FIG. 1 knife holder.

In order to provide for easy grasping of the knife holding block 24 so that it can be moved between the retracted position and the extended position, it is preferable to provide a handle or other type of grasping structure on the knife holding block. As shown in FIGS. 1 and 2, laterally extending grasping members 27 and 29 are glued to the front portions of the side walls 26 and 28 respectively. Although the grasping members 27 and 29 are illustrated as extending substantially the entire height of each side wall 26, 28, respectively, it is possible to provide the grasping member on only a portion of one or both of the side walls. Since the only function of the grasping members is to enable the knife holding block 24 to be moved between the retracted and extended positions, they need not extend the entire height of each side wall. The provision of a single grasping member that extends on only a small part of one of the side walls would result in an overall structure that is very narrow laterally, and thus occupies a minimal amount of lateral space. Such an arrangement would be most excellent in environments where very small amounts of lateral space were available.

As another option, labels can be provided on the knife holder 20 identifying the type of knife to be inserted in each slot. The labels can be located below each slot, particularly when the grasping members 27 and 29 of FIG. 1 are provided. Alternatively, the labels can be located on other portions of the knife holding block 24.

The knife holder 20 can be sold with or without knives 50. Preferably, the knife holder 20 is provided with knives. The knife holder 20 and the knife handles can be provided in a variety of colors or color combinations so as to have a pleasing appearance. When made from plastic, the knife holder 20 (or at least the block 24) can be white, for example, and the knife handles can be black. When made from wood, the knife holder and knife handles can be provided in a variety of finishes such as, for example, light oak, bleached oak, honey oak, walnut, cherry, maple, mahogany, etc., so as to match the finish of typical kitchen cabinets.

Figure 6:
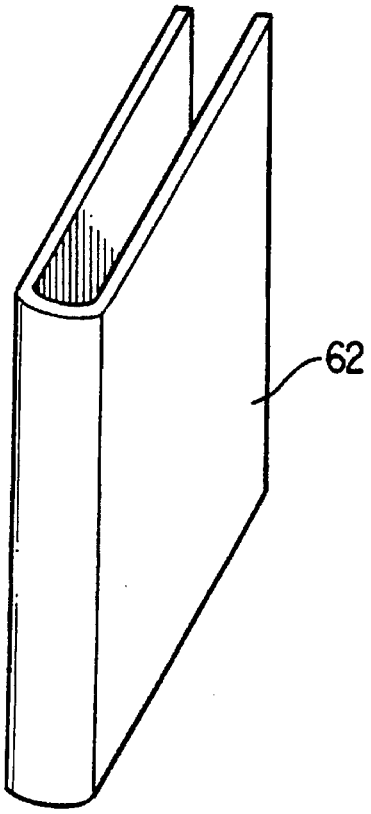
FIG. 6 is a perspective view of a divider member that can be used with a modified version of the FIG. 1 embodiment to provide for additional vertical lines of knife holding slots.
Figure 7:
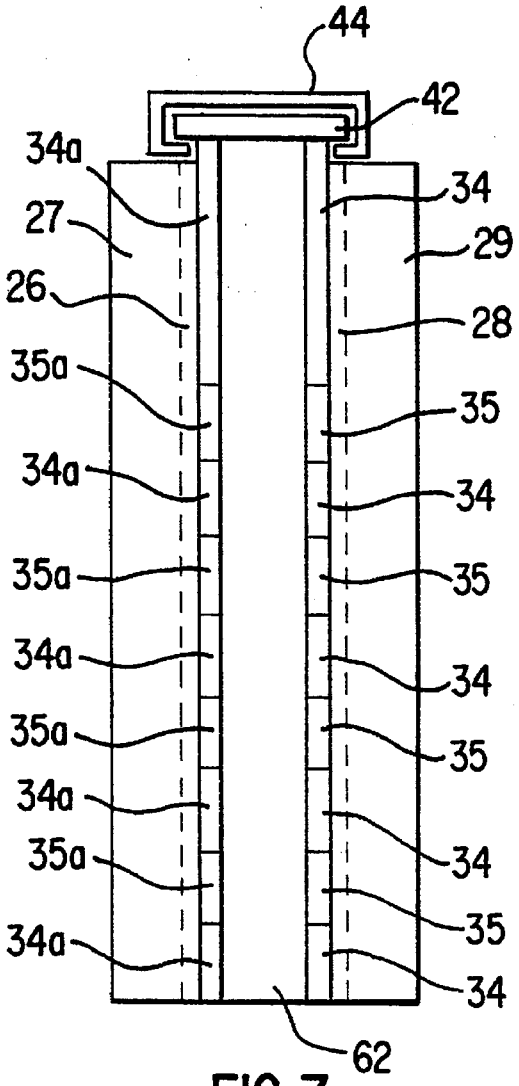
FIG. 7 is a front view of the modified version of the FIG. 1 embodiment in which two vertical lines of knife holding slots are provided.

In order to enable additional knives to be held in the knife holding block without substantially increasing the length of the knife holding block, it is possible to provide two or more vertically extending lines of slots. This can be accomplished by providing the structure illustrated in FIGS. 6 and 7. FIG. 6 is a perspective view of a divider member 62 that can be used in conjunction with additional spacer elements **34*a* to provide an additional vertical line of slots 35*a*. The divider member 62 and the additional plurality of spacer elements 34*a* can be provided as shown in FIG. 7 so that two vertical lines of slots 35 and 35*a* are provided. The additional line of slots preferably is immediately adjacent to the first line of slots, as shown in FIG. 7**; however, it also can be offset from the first line of slots.

FIGS. 8–11 illustrate an alternative embodiment of the invention. In this alternative embodiment, a knife holder 120 includes a line of knife holding slots that extends in the horizontal direction.

Figure 8:
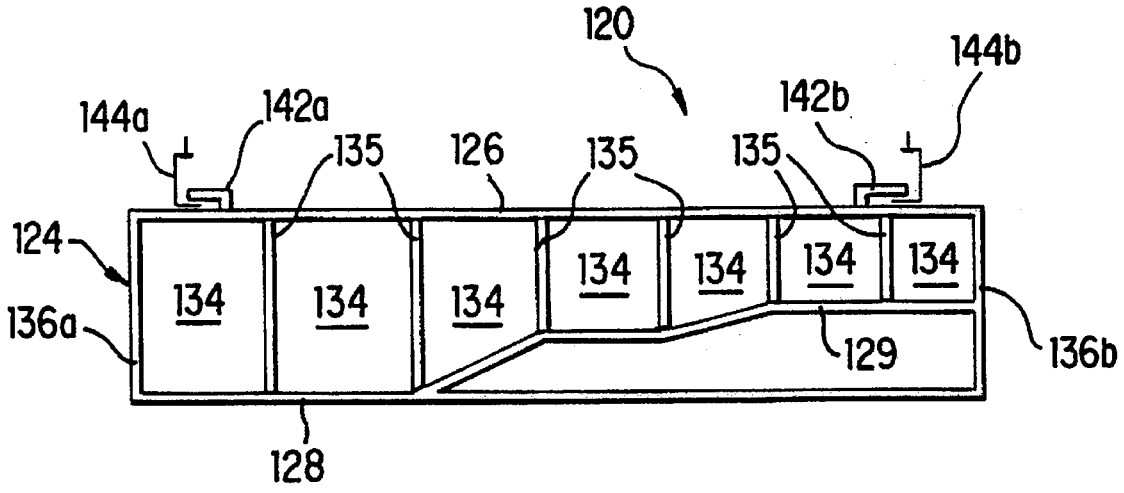
FIG. 8 is a front view of a second embodiment of the invention in which the line of slots extends in a horizontal direction.
Figure 9:
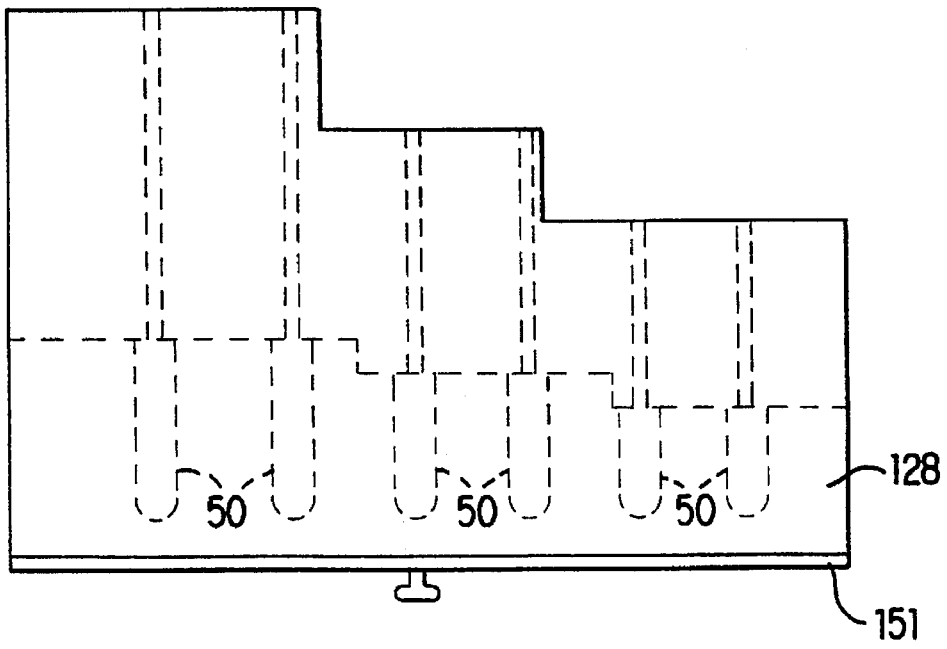
FIG. 9 is a top view of the FIG. 8 embodiment.

Referring to FIGS. 8 and 9, the knife holding block 124 of the second embodiment includes a first (upper) wall 126 that extends in a horizontal plane and a second (lower) wall 128 that also extends in a horizontal plane. A plurality of spacer elements 134 are provided between the first wall 126 and the second wall 128. The spacer elements 134 can be one-piece with the upper wall 126 or with the lower wall 128, or can be separate elements that are attached (for example, by gluing or with screws) to the upper wall 126 and the lower wall 128. Left and right side walls **136*a* and 136*b* also are attached between the upper wall 126 and the lower wall 128. Alternatively, the end spacer elements 134** can function as side walls for the knife holder.

In the FIG. 8 embodiment, a second lower wall 129 is provided between a portion of the lower wall 128 and the spacer elements that are provided between the slots 135 for smaller knives. It is desirable to make the height of the slots such that they correspond to the height of the knife blade to be placed therein to assist in maintaining the knife in place. It is possible, however, to construct the knife holder so that all of the slots have the same height, in which case second lower wall 129 is not required. Additionally, the spacer elements for smaller knives could be shaped so that they will provide smaller height slots without the requirement for second lower wall 129, as will be described below in conjunction with FIG. 11.

Figure 10:
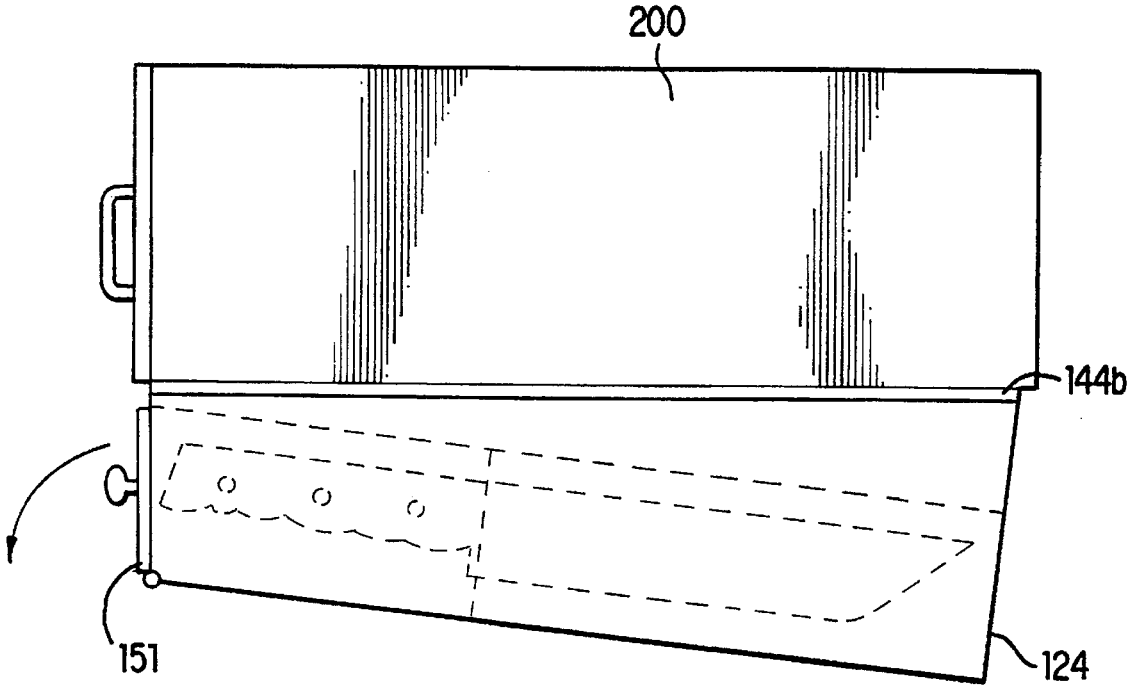
FIG. 10 is a side view of the FIG. 8 embodiment mounted below a cabinet.

As can be seen in FIG. 9, which is a top view of the knife holder 120, the lower wall 128 extends beyond the front surfaces of the spacer elements 134 to provide a ledge over which the handles of the knives 50 extend. This allows a front cover 151, as shown in FIG. 10, to be provided on the knife holder 120. The cover 151 can be pivotally attached to the lower wall 128 so that it can swing between closed and opened positions as shown by the arrow in FIG. 10.

First parts **142*a* and 142*b* of a slidable mount are provided on the upper wall 126. In the FIG. 8 embodiment, L-shaped plastic bars comprise the first parts 142*a* and 142*b* of the slidable mount, with the shorter leg of the L being glued to upper wall 126 so that the longer leg of the L extends laterally outward as shown in FIG. 8. Second parts 144*a* and 144*b* of the slidable mount can be attached below a cabinet or counter and are slidably engagable with the L-shaped first parts 142*a* and 142*b*** of the slidable mount.

Accordingly, the horizontally extending knife holder can be mounted below a cabinet 200 as shown in FIG. 10 so that the knife holding block 124 slides to the left and to the right in FIG. 10. FIG. 10 shows the knife holder 120 in the retracted position. As with the previous embodiment, the knife holder is mounted so that the handles of the knives are located below the support structure (the cabinet in FIG. 10). Accordingly, the knife handles do not protrude beyond the front surface of the cabinet and do not interfere with movement in front of the cabinet. When it is desired to use a knife, the knife holding block 124 can be pulled outward (to the left in FIG. 10) so that at least the handles of the knives extend beyond the front surface of the cabinet and are readily accessible.

In the FIG. 8 embodiment, the spacer elements 134 have a depth that corresponds to the length of the blade of the particular knives that they are to separate. This results in the back surface of the knife holder having an irregular shape, as can be seen in FIG. 9. FIG. 9 also illustrates that the front surfaces of the spacer elements 134 are positioned relative to the length of the knife handles so that all of the knife handles will extend forward to a common plane. As an alternative, all of the spacer elements can have the same length so that the front and rear surfaces of the knife holding block are flat. Additionally, the knife holder can be provided without the front cover 151 and without the lower wall 128 providing a ledge. This more simplified knife holder 220 is illustrated in FIG. 11.

Figure 11:
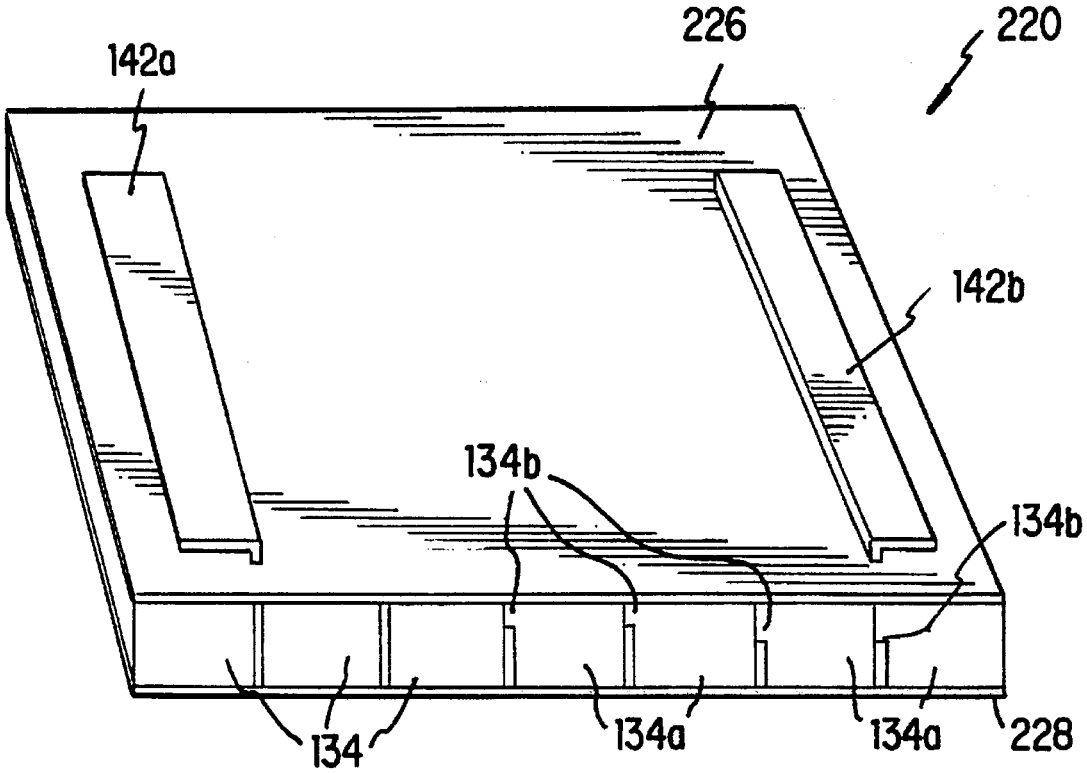
FIG. 11 is a perspective view of a more simplified knife holder having a horizontally extending line of slots.

FIG. 11 also illustrates a design in which the second lower wall 129 is not needed. In the FIG. 11 embodiment, the spacer elements 134*a* that are provided for smaller sized knives include protruding portions 134*b* that vary the height of the slots. The upper wall 226 and the lower wall 228 have a regular, square or rectangular shape. Separate side walls are not required. Instead, the end-most spacer elements form the sides of the knife holding block.

The embodiments of FIGS. 8–11 can be mounted to the bottom of a support structure so that the line of slots extends horizontally, or to the side of a support structure so that the line of slots extends vertically.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A slidable knife holder comprising:

a knife holding block including a plurality of knife holding slots, each slot for receiving a knife therein, a first part of a slidable mount being provided on an external surface of said knife holding block; and a second part of the slidable mount, said second part including an attachment element that enables said second part to be mounted to a support, said second part being slidably engaged with said first part such that said first part and said second part are slidable relative to each other in a first direction, said knife holding block moving with said first part in said first direction so that said block moves between a retracted position, in which handles of knives in said block are not readily accessible, and an extended position, in which the knife handles are exposed and readily accessible.

2. The knife holder of claim 1, wherein said knife holding block includes a first wall, a second wall, and a plurality of spacer elements attaching said first wall to said second wall and defining at least one line of said plurality of knife holding slots.

3. The knife holder of claim 2, wherein said plurality of spacer elements are separate pieces from said first wall and said second wall, said plurality of spacer elements being attached between said first wall and said second wall.

4. The knife holder of claim 2, wherein said first wall and said second wall are planar and extend in parallel planes.

5. The knife holder of claim 4, wherein said first part of said slidable mount is provided on a surface of one of said first wall and said second wall.

6. The knife holder of claim 4, wherein said first part of said slidable mount is attached to edges of said first wall and of said second wall.

7. The knife holder of claim 1, wherein said first part of said slidable mount includes a pair of extending wings, and said second part of said slidable mount includes a pair of slots that receive said pair of wings.

8. A slidable knife holder comprising:

a knife holding block including:

a first wall and a second wall that extend in substantially parallel planes;

a plurality of spacer elements attaching said first wall to said second wall, said plurality of spacer elements being spaced from each other to define a plurality of knife holding slots that extend in at least one line between said first wall and said second wall; and a first part of a slidable mount provided on a surface of said knife holding block; and a second part of the slidable mount, said second part including an attachment element that enables said second part to be mounted to a support, said second part being slidably engaged with said first part such that said first part and said second part are slidable relative to each other in a first direction, said knife holding block moving with said first part in said first direction so that said block moves between a retracted position and an extended position.

9. The knife holder of claim 8, wherein said plurality of spacer elements are separate pieces from said first wall and said second wall, said plurality of spacer elements being attached between said first wall and said second wall.

10. The knife holder of claim 8, wherein said first part of said slidable mount is provided on a surface of one of said first wall and said second wall.

11. The knife holder of claim 8, wherein said first part of said slidable mount is attached to edges of said first wall and of said second wall.

12. The knife holder of claim 8, wherein said first part of said slidable mount includes a pair of extending wings, and said second part of said slidable mount includes a pair of slots that receive said pair of wings.

13. The knife holder of claim 8, further comprising a divider member having first and second surfaces and being located between said first wall and said second wall, some of said spacer elements attaching said first wall to said first surface of said divider member to define a first line of said knife holding slots, others of said spacer elements attaching said second wall to said second surface of said divider member to define a second line of said knife holding slots such that said knife holder includes two lines of said knife holding slots.

14. A slidable knife holder comprising:

a knife holding block including:

a first vertical side wall and a second vertical side wall that extend in parallel vertical planes;

a plurality of spacer elements attaching said first vertical side wall to said second vertical side wall, said plurality of spacer elements being spaced from each other to define a plurality of knife holding slots that extend in at least one vertical line located between said first vertical side wall and said second vertical side wall, said at least one vertical line of slots extending between a top of said block and a bottom of said block; and a first part of a slidable mount provided on said knife holding block; and a second part of the slidable mount, said second part including an attachment element that enables said second part to be mounted to a support, said second part being slidably engaged with said first part such that said first part and said second part are slidable relative to each other in a horizontal direction, said knife holding block moving with said first part in said horizontal direction so that said block moves between a retracted position, in which handles of knives in said block are not readily accessible, and an extended position, in which the knife handles are exposed and readily accessible.

15. The knife holder of claim 14, wherein said plurality of spacer elements are separate pieces from said first vertical side wall and said second vertical side wall, said plurality of spacer elements being attached between said first vertical side wall and said second vertical side wall.

16. The knife holder of claim 14, wherein said first part of said slidable mount is provided on the top of said knife holding block.

17. The knife holder of claim 14, wherein said first part of said slidable mount includes a pair of extending wings, and said second part of said slidable mount includes a pair of slots that receive said pair of wings.

18. The knife holder of claim 14, further comprising a divider member having first and second surfaces and being located between said first vertical side wall and said second vertical side wall, some of said spacer elements attaching said first vertical side wall to said first surface of said divider member to define a first vertical line of said knife holding slots, others of said spacer elements attaching said second vertical side wall to said second surface of said divider member to define a second vertical line of said knife holding slots such that said knife holder includes two vertical lines of said knife holding slots.

19. The knife holder of claim 14, further comprising a grasping member provided on said knife holding block to enable said knife holding block to be grasped for movement between said retracted position and said extended position.

20. The knife holder of claim 19, wherein said grasping member is glued to at least one of said first vertical side wall and said second vertical side wall.

* * * * *